US009247629B2

(12) United States Patent
Vahidpour et al.

(10) Patent No.: US 9,247,629 B2
(45) Date of Patent: Jan. 26, 2016

(54) WAVEGUIDE-BASED APPARATUS FOR EXCITING AND SUSTAINING A PLASMA

(71) Applicant: Agilent Technologies, Inc., Loveland, CO (US)

(72) Inventors: Mehrnoosh Vahidpour, Santa Clara, CA (US); Geraint Owen, Palo Alto, CA (US)

(73) Assignee: AGILENT TECHNOLOGIES, INC., Santa Clara, CA (US)

( * ) Notice: Subject to any disclaimer, the term of this patent is extended or adjusted under 35 U.S.C. 154(b) by 253 days.

(21) Appl. No.: 13/838,474

(22) Filed: Mar. 15, 2013

(65) Prior Publication Data

US 2014/0265850 A1 Sep. 18, 2014

(51) Int. Cl.

| | |
|---|---|
| ***H05H 1/26*** | (2006.01) |
| ***H05H 1/30*** | (2006.01) |
| ***H05H 1/46*** | (2006.01) |

(52) U.S. Cl.

CPC . *H05H 1/26* (2013.01); *H05H 1/30* (2013.01); *H05H 1/46* (2013.01); *H05H 2001/4622* (2013.01)

(58) Field of Classification Search

CPC ..... H05H 1/26; H05H 2001/4622

See application file for complete search history.

(56) References Cited

U.S. PATENT DOCUMENTS

| | | | | |
|---|---|---|---|---|
| 2,882,502 | A * | 4/1959 | Freundlich | H01P 1/08 333/252 |
| 3,029,361 | A * | 4/1962 | Hernqvist | 376/124 |
| 3,052,614 | A * | 9/1962 | Herold | 376/123 |
| 3,149,222 | A * | 9/1964 | Giannini et al. | 219/121.44 |
| 3,294,953 | A * | 12/1966 | Spies, Jr. | 219/121.36 |
| 3,937,917 | A * | 2/1976 | Consoli | 219/121.36 |
| 4,933,650 | A | 6/1990 | Okamoto | |
| 5,325,020 | A | 6/1994 | Campbell et al. | |
| 6,683,272 | B2 | 1/2004 | Hammer | |
| 7,030,979 | B2 | 4/2006 | Hammer | |
| 8,039,795 | B2 | 10/2011 | Mordehai et al. | |
| 8,048,329 | B2 | 11/2011 | Kamarehi et al. | |
| 8,773,225 | B1 * | 7/2014 | Vahidpour | 315/111.21 |
| 2002/0050323 | A1 | 5/2002 | Moisan et al. | |
| 2003/0111445 | A1 * | 6/2003 | Hammer | H05H 1/24 219/121.48 |
| 2013/0126488 | A1 * | 5/2013 | Lee et al. | 219/121.48 |
| 2014/0062299 | A1 * | 3/2014 | Hammer | H05H 1/30 315/39 |
| 2014/0265850 | A1 * | 9/2014 | Vahidpour | H05H 1/26 315/111.21 |

OTHER PUBLICATIONS

International Search Report and Written Opinion mailed May 8, 2014 for International Application No. PCT/US2014/016920.

(Continued)

*Primary Examiner* — Tung X Le
*Assistant Examiner* — Srinivas Sathiraju

(57) ABSTRACT

An apparatus includes an electromagnetic waveguide; an iris structure providing an iris in the waveguide. The iris structure may define an iris hole, a first iris slot at a first side of the iris hole, and a second iris slot at a second side of the iris hole. A plasma torch is disposed within the iris hole. An electric field in the waveguide changes direction from the first iris slot to the second iris slot. The plasma torch generates a plasma which is substantially symmetrical around a longitudinal axis of the plasma torch, such that the plasma may have a substantially toroidal shape. In some embodiments, a dielectric material is disposed in the iris hole, outside of the plasma torch. In some embodiments, the height of at least one of the iris slots is greater at the ends thereof than in the middle.

20 Claims, 11 Drawing Sheets

(56) References Cited

OTHER PUBLICATIONS

A. Sotgiu et al. "Electric fields and losses in lumped element resonators for ESR spectroscopy", J. Phys. E: Sci. Instrum. 20 (1987) pp. 1487-1490.

Michael R. Hammer, "A magnetically excited microwave plasma source for atomic emission spectroscopy with performance approaching that of the inductively coupled plasma", Spectrochimica Acta Part B 63 (2008), pp. 456-464.

Merdad Mehdizadeh, et al., "Loop-Gap Resonator: A Lumped Mode Microwave Resonant Structure", IEEE Transactions on Microwave Theory and Techniques, vol. MTT-31, No. 12, Dec. 1983, pp. 1059-1064.

W. N. Hardy et al., "Split-ring resonator for use in magnetic resonance from 200-2000 MHz", Rev. Sci. Instrum. 52(2), Feb. 1981, pp. 213-216.

* cited by examiner

WAVEGUIDE-BASED APPARATUS FOR EXCITING AND SUSTAINING A PLASMA

BACKGROUND

Emission spectroscopy based on plasma sources is a well accepted approach to elemental analysis. It is desired that an electrical plasma suitable as an emission source for atomic spectroscopy of a sample should satisfy a number of criteria. The plasma should produce desolvation, volatilization, atomization and excitation of the sample. However the introduction of the sample to the plasma should not destabilize the plasma or cause it to extinguish.

One known and accepted plasma source for emission spectroscopy is a radio frequency (RF) inductively coupled plasma (ICP) source, typically operating at either 27 MHz or 40 MHz. In general, with an RF ICP source the plasma is confined to a cylindrical region, with a somewhat cooler central core. Such a plasma is referred to as a "toroidal" plasma. To perform spectroscopy of a sample with an RF ICP source, a sample in the form of an aerosol laden gas stream may be directed coaxially into this central core of the toroidal plasma.

Although such plasma sources are known and work well, they generally require the use of argon as the plasma gas. However, argon can be somewhat expensive and is not obtainable easily, or at all, in some countries.

Accordingly, there has been ongoing interest for many years in a plasma source supported by microwave power (for example at 2.45 GHz where inexpensive magnetrons are available) which can use nitrogen, which is cheaper and more widely available than argon, as the plasma gas.

However, emission spectroscopy systems based on microwave plasma sources have generally shown significantly worse detection limits than systems which employ an ICP source, and have often been far more demanding in their sample introduction requirements.

For optimum analytical performance of the emission spectroscopy system, it is thought that the plasma should be confined to a toroidal region, mimicking the plasma generated by an RF ICP source.

It turns out to be much more difficult to produce such a toroidal plasma using microwave excitation than it is in for RF ICP source. With an RF ICP source, a current-carrying coil, wound along the long axis of a plasma torch, is used to power the plasma. The coil produces a magnetic field which is approximately axially oriented with respect to the long axis of the plasma torch, and this, in turn, induces circulating currents in the plasma, and these currents are symmetrical about the long axis of the plasma torch. Thus, the electromagnetic field distribution in the vicinity of the plasma torch has inherent circular symmetry about the long axis of the plasma torch. So it is comparatively easy to produce a toroidal plasma with an RF ICP source.

However, the waveguides used to deliver power to microwave plasmas do not have this type of circular symmetry, and so it is much more difficult to generate toroidal microwave plasmas.

There is therefore a desire to provide an improved microwave plasma source which can offer performance which approaches that of RF ICP, together with characteristics such as small size, simplicity and relatively low operating costs.

BRIEF DESCRIPTION OF THE DRAWINGS

The various embodiments are best understood from the following detailed description when read with the accompanying drawing figures. Wherever applicable and practical, like reference numerals refer to like elements.

DETAILED DESCRIPTION

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings.

Generally, it is understood that as used in the specification and appended claims, the terms "a", "an" and "the" include both singular and plural referents, unless the context clearly dictates otherwise. Thus, for example, "a device" includes one device and plural devices.

The present teachings relate generally to an apparatus including a waveguide in combination with a plasma torch to generate and sustain a plasma useful in spectrochemical analysis. The present inventors have conceived and produced novel iris structures for a waveguide which may cause the electric field in the waveguide to experience a phase shift or change in direction across the iris structure from a first side of the iris structure to a second side of the iris structure opposite the first side. Here, an iris is defined as a region of discontinuity inside the waveguide which presents an impedance mismatch (a perturbation) that blocks or alters the shape of the pattern of an electromagnetic field in the waveguide. In some embodiments, the iris can be produced by a reduction in the height and width of the interior of the waveguide, as is discussed in greater detail below.

In particular, the present inventors have discovered that by employing certain iris structure configurations, the electric field may be caused to experience a phase shift of 180 degrees across the iris structure, producing a reversal in direction of the electric field from the first side of the iris structure to the second side of the iris structure such that the electric field at the second side of the iris structure is in an opposite direction from the electric field at first side of the iris structure. By employing these configurations, a toroidal plasma may be generated. A more detailed explanation will be provided in connection with example embodiments illustrated in the attached drawings.

Figure 1:
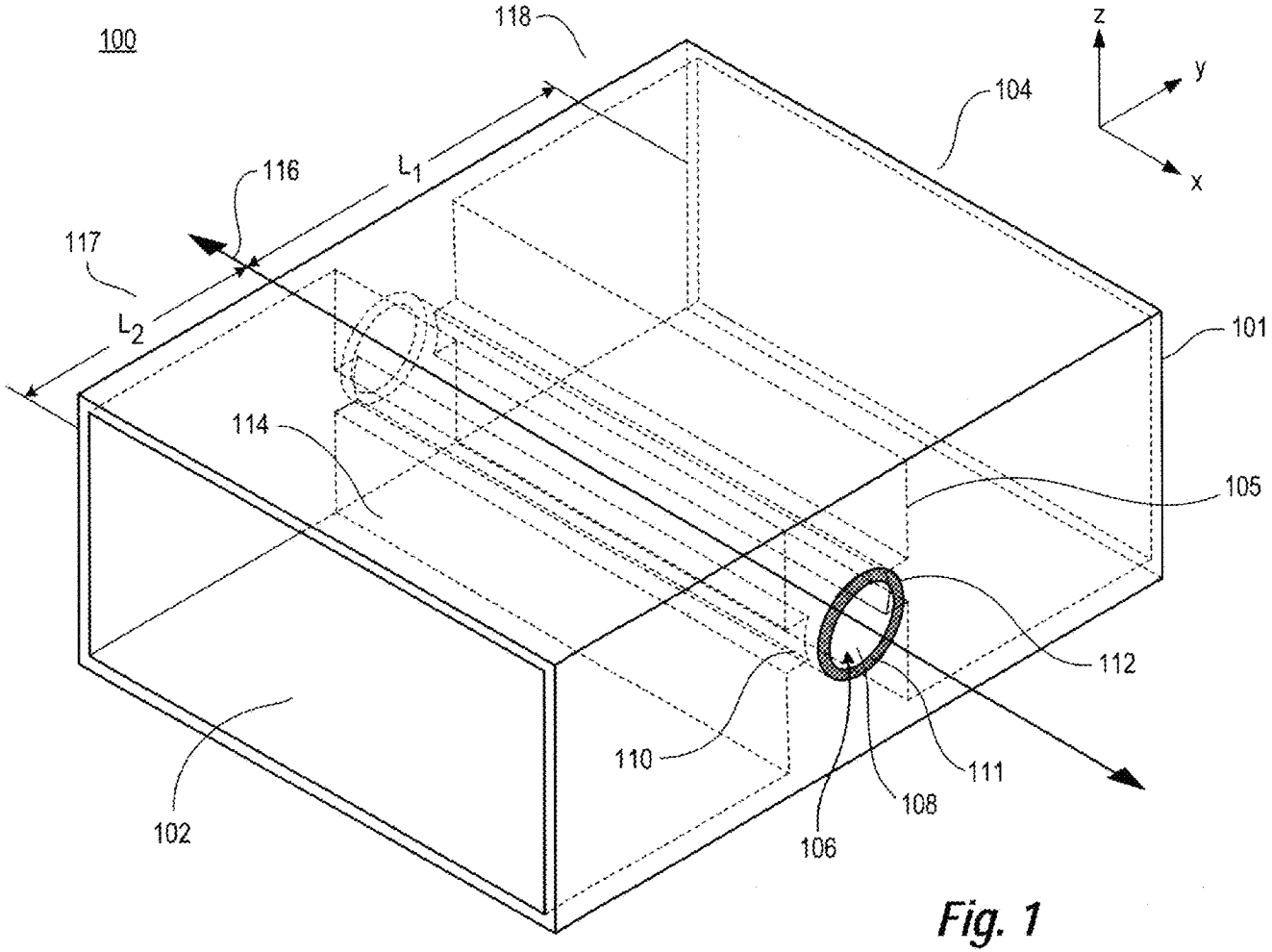
FIG. 1 is a perspective view of a portion of an apparatus according to a first example embodiment.

FIG. 1 is a perspective view of a portion of an apparatus 100 according to a first example embodiment. Apparatus 100 may comprise a waveguide-based apparatus for exciting and sustaining a plasma.

To facilitate a better understanding of the description below, FIG. 1 also shows a set of three orthogonal directions, x, y, and z, which together span a three-dimensional space. In the description below, the x, y, and z directions are designated "width," "length," and "height," respectively. Of course it should be understood that the assignment of the terms "width," "length," and "height" to the x, y, and z directions, respectively, in this disclosure is arbitrary and the terms could be assigned differently. To facilitate a better understanding of the embodiments disclosed herein, various combinations of the x, y, and z directions are shown in various drawings, but in all cases the directions are used consistently throughout the drawings.

Apparatus 100 comprises an electromagnetic waveguide ("waveguide") 101 which is configured to support a desired propagation mode ("mode") at a frequency suitable for generating and sustaining a plasma, and an iris 106 where a plasma torch (not shown in FIG. 1, but see FIGS. 4 and 5 below) is disposed.

Waveguide 101 is configured to support a desired mode of propagation (e.g., $TE_{10}$) at a microwave frequency. Although the embodiment of waveguide 101 illustrated in FIG. 1 is a rectangular box with a rectangular cross section across the direction of propagation (the y-direction), it will be understood that other waveguide shapes with other types of cross-sections are contemplated. In apparatus 100, waveguide 101 is disposed adjacent to a source of microwave energy (not shown) at a first end 102 thereof, and is short-circuited at a second end 104 which is separated and spaced apart from first end 102 along the y-direction to define the length of waveguide 101.

Iris 106 is provided in waveguide 101 by an iris structure 105 which defines an iris hole 108 with a first iris slot 110 disposed at or along a first side of iris hole 108 and a second iris slot 112 disposed at or along a second side of iris hole 108, wherein the first and second sides are separated and spaced apart from each other in the y-direction. In general, first and second iris slots 110 and 112 may have the same size and shape as each other, or the sizes and/or shapes may be different from each other.

In operation, an electromagnetic wave may propagate from first end 102 of waveguide 101, pass through first iris slot 110, iris hole 108, and second iris slot 112, and reach second end 104 of waveguide 101.

In the embodiment illustrated in FIG. 1, iris hole 108 has a cylindrical shape, having a principal axis 116 of the cylinder extending in the x-direction across the width of waveguide 101 and having a substantially circular cross-section in a plane defined by the y-direction and z-direction. The first and second iris slots 110 and 112 may be disposed at or along opposite sides of iris hole 108. In other embodiments, iris hole 108 has a shape which is not cylindrical. For example, in some embodiments iris hole 108 may have the shape of a rectangular prism, a hexagonal prism, an octagonal prism, an oval cylinder, etc. In some embodiments, the iris hole is symmetrical around an axis and has no sharp angles.

In some embodiments, the center of the iris 106 (e.g. at principal axis 116) is disposed at a distance (represented as a first length L1 in FIG. 1) in the y-direction from first end 102 of waveguide 101. Moreover, in some embodiments, the center of the iris 106 (e.g. at principal axis 116) is disposed a distance (represented as a second length L2 in FIG. 1) in the y-direction from second end 104 of waveguide 101. As such, iris 106 is positioned between a first portion 117 of the waveguide 101 and a second portion 118 of the waveguide 101. Notably, the waveguide 101 may be a single piece comprising first and second portions 117, 118 with iris 106 positioned therein. Alternatively, waveguide 101 may comprise two separate pieces (e.g., first and second portions 117, 118 being separate pieces) with iris 106 positioned therebetween.

Figure 4:
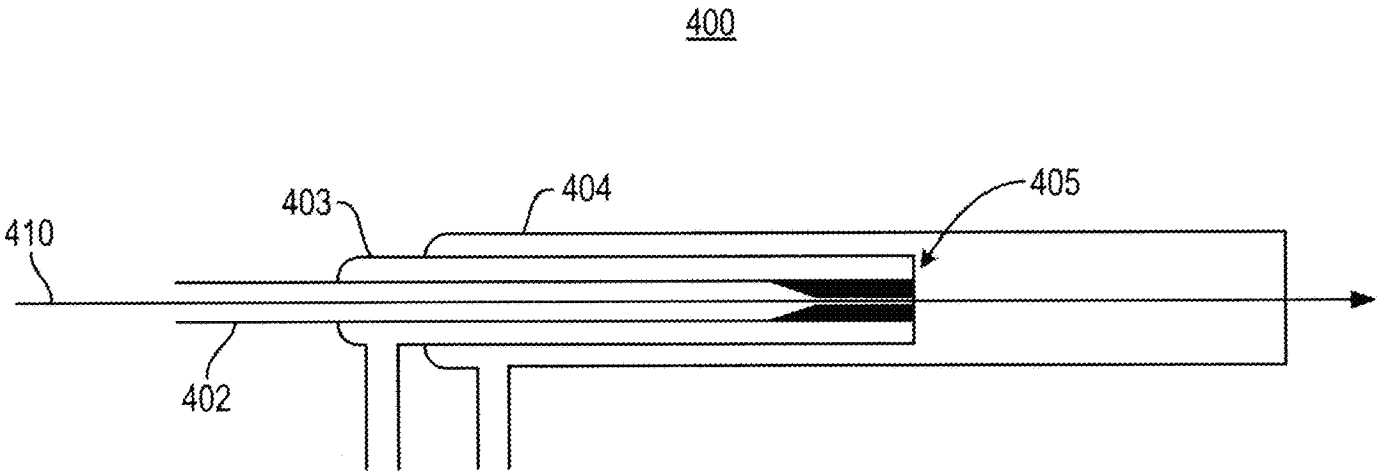
FIG. 4 is an end view of an example embodiment of a plasma torch.
Figure 5:
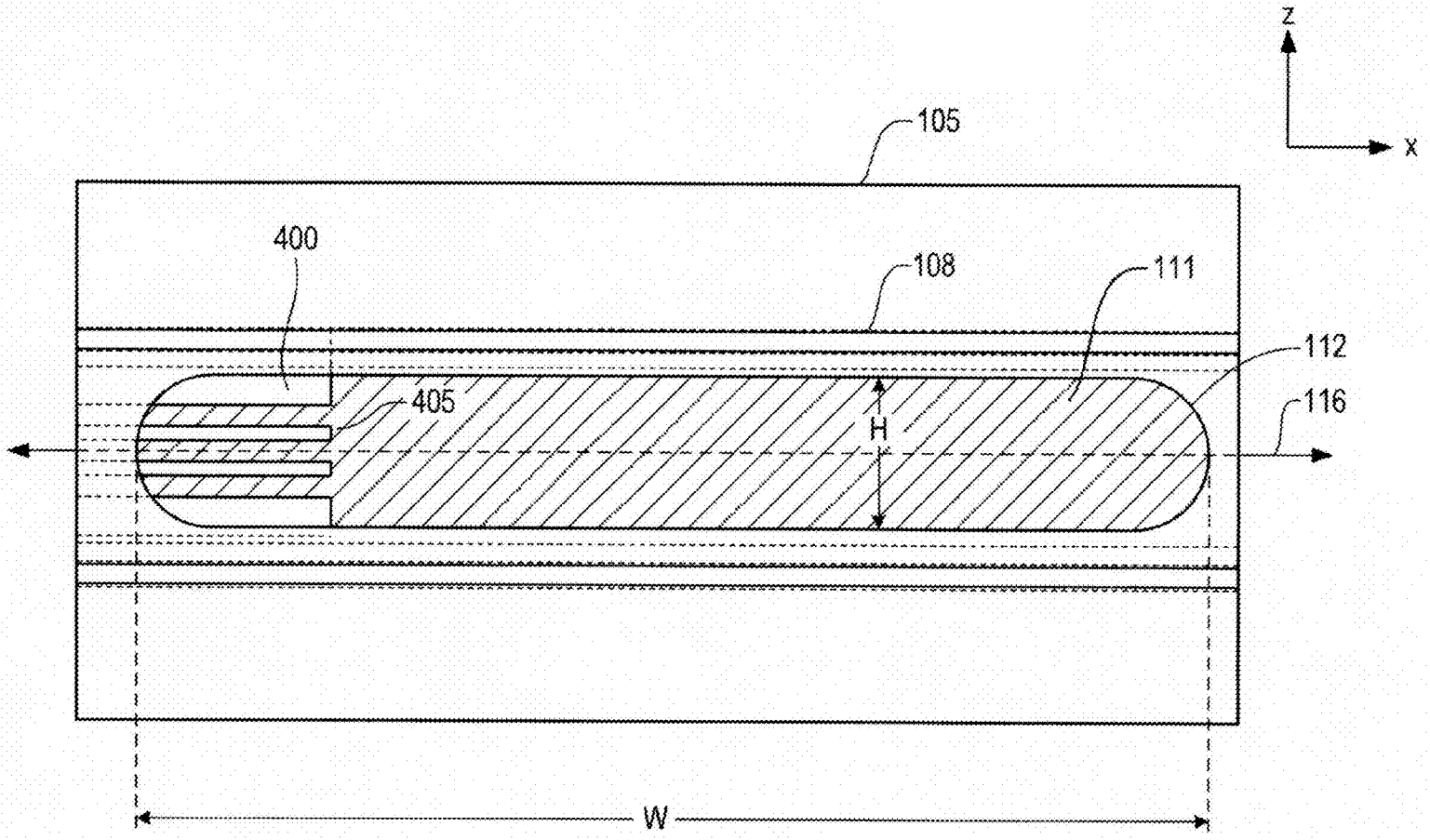
FIG. 5 is an end view of a portion of an example embodiment of an apparatus including an iris structure with a plasma torch disposed therein.

In some embodiments, iris structure 105 which defines iris 106 may be a metal section having a thickness dimension along the length (y-direction) of waveguide 101, with a through-hole extending in the x-direction through the width of the metal section to define iris hole 108 which is configured to accommodate therein a plasma torch (see FIGS. 4 and 5). Waveguide 101 and iris structure 105 defining iris 106 in apparatus 100 are each made of a suitable electrically conductive material, such as a metal (e.g. aluminum) or metal alloy suitable for use at the selected frequency of operation of the apparatus 100. In some embodiments, iris structure 105 may be integral to waveguide 101. In other embodiments, iris structure 105 may be a separate structure inserted in waveguide 101. Certain aspects of waveguide 101 and iris 106 are common to the corresponding features described in commonly owned U.S. Pat. No. 6,683,272 to Hammer. The disclosure of U.S. Pat. No. 6,683,272 is specifically incorporated by reference herein.

As will be described in greater detail below, in some embodiments iris hole 108 may include disposed therein a dielectric material, for example a cylindrical dielectric tube or sleeve 111 as illustrated in the example embodiment apparatus 100 in FIG. 1.

Figure 2:
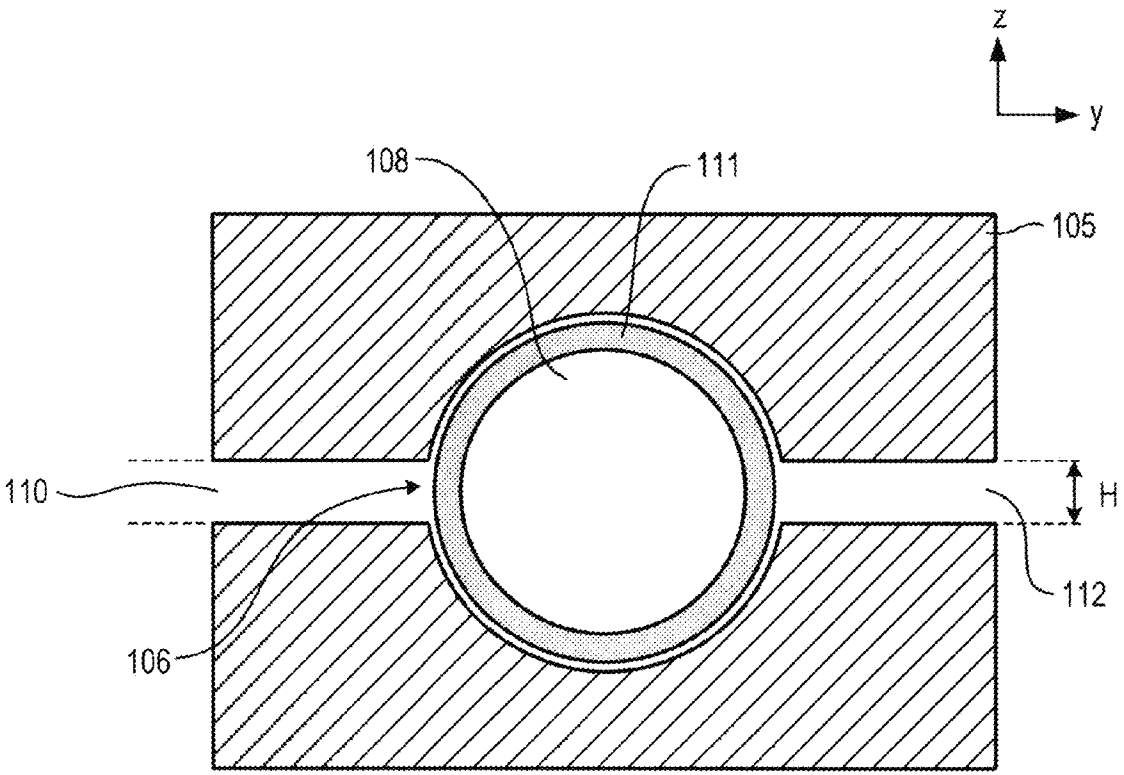
FIG. 2 is a cutaway cross-sectional view of a portion of the apparatus according to the first example embodiment.

FIG. 2 is a cutaway cross-sectional view of a portion of apparatus 100, which more clearly illustrates iris structure 105 defining iris 106, including iris hole 108 with the dielectric material, and specifically cylindrical dielectric sleeve 111, disposed therein.

Figure 3:
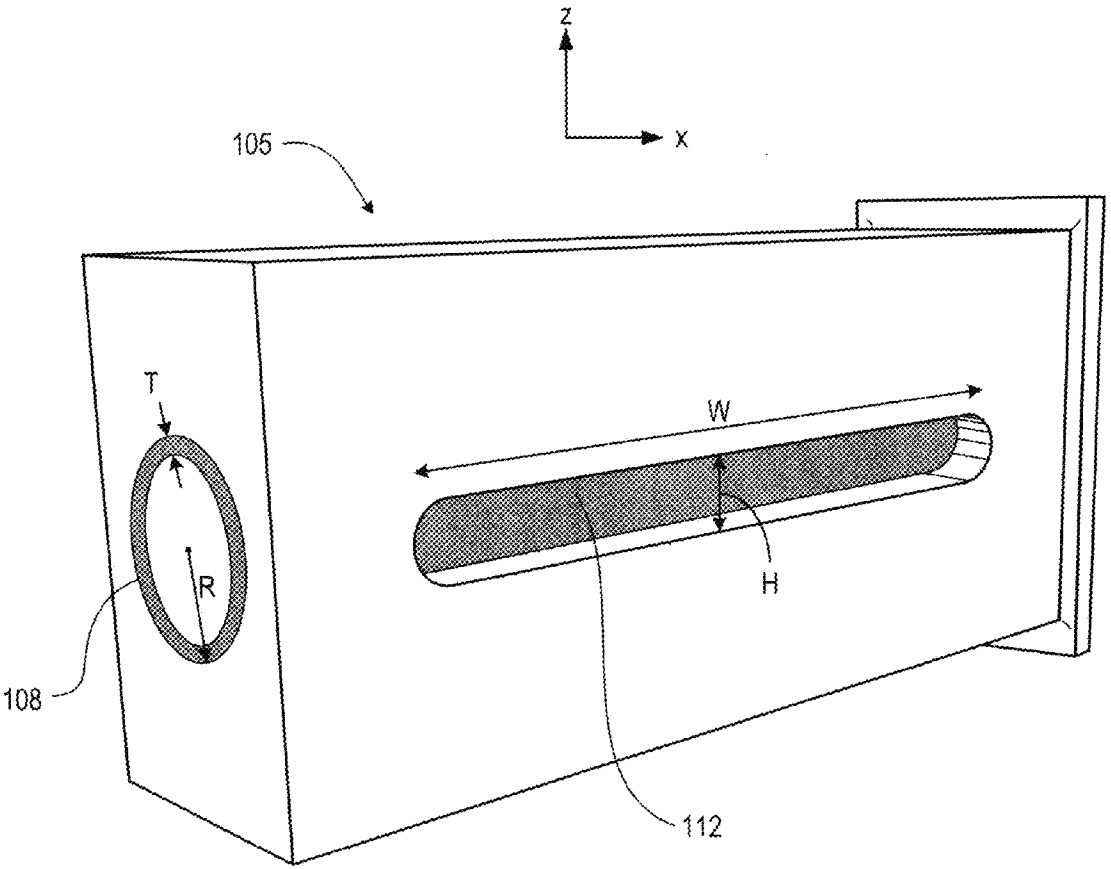
FIG. 3 is a perspective view of an example embodiment of an iris structure for defining an embodiment of an iris for a waveguide.

FIG. 3 is a perspective view of an example embodiment of an iris structure 105 for defining iris 106, having iris hole 108 and second iris slot 112 at or along a side of iris hole 108. FIG. 3 also illustrates cylindrical dielectric sleeve 111 having a thickness "T" disposed within cylindrical iris hole 108 having a radius "R." FIG. 3 also illustrates that second iris slot 112 has a width "W" and a height "H." In some embodiments, the width W is less than a width of waveguide 101, and height H is less than the diameter of the cross section of cylindrical iris hole 108. As mentioned above, it should be understood that first iris slot 110, which is not seen in FIG. 3, may have the same configuration as second iris slot 112, or its size and/or shape may be different.

As noted above, iris hole 108 may be configured to accommodate therein a plasma torch. A plasma torch is a device with a conduit or channel for delivering a plasma gas, which, upon contacting the electromagnetic waves, produces a plasma. The plasma torch may also comprise a conduit or channel for delivering a sample in the form of an aerosol or gas to a location where plasma forms. Plasma torches are known in the art.

FIG. 4 is an end view of an example embodiment of a plasma torch 400. Plasma torch 400 includes three concentric injectors or tubes 402, 403, 404, each of which may be made of a non-conducting material, such as quartz or ceramic. The concentric tubes of plasma torch 400 share a common central longitudinal axis 410 which, when plasma torch 400 is inserted into iris hole 108, may be oriented parallel to, or aligned with, the principal axis 116 of iris hole 108, as shown in FIG. 1.

FIG. 5 is an end view of a portion of an example embodiment of an apparatus including iris structure 105 with plasma torch 400 disposed therein. As shown in FIGS. 4 and 5, plasma torch 400 includes a tip 405, and is inserted in iris hole 108.

In operation, when plasma torch 400 is inserted into iris hole 108, a carrier gas with an entrained sample to be spectroscopically analyzed normally flows through innermost tube 402, an intermediate gas flow is provided in intermediate cylinder 403, and a plasma-sustaining and torch-cooling gas flow is provided in outermost tube 404. In some embodiments, the plasma-sustaining and torch-cooling gas may be nitrogen. For example, the plasma-sustaining and torch-cooling gas may be nitrogen, and arrangements are provided for producing a flow of this gas conducive to form a stable plasma having a substantially hollow core, and to prevent plasma torch 400 from becoming overheated. For example, in some embodiments the plasma-sustaining gas may be injected radially off-axis so that the flow spirals. This gas flow sustains the plasma and the analytical sample carried in the inner gas flow is heated by radiation and conduction from the plasma. In some embodiments, for the purpose of initially igniting the plasma, the plasma-sustaining and torch-cooling gas flow may temporarily and briefly be changed: for example, from nitrogen to argon.

A more detailed description of an example embodiment of a plasma torch is described in detail in commonly owned U.S. Pat. No. 7,030,979 to Hammer. The disclosure of U.S. Pat. No. 7,030,979 is specifically incorporated herein by reference. It will be understood that other configurations of a plasma torch, and other suitable means of injecting the sample to be analyzed and the plasma gas into iris 106, are contemplated.

As indicated above, a selected mode is supported in waveguide 101 when not perturbed. However, the iris 106 presents a perturbation that alters the wavelength and shape of the mode in the waveguide 101. By virtue of the structure of waveguide 101 and iris 106, a plasma may be generated and sustained in a desired shape.

In some embodiments, waveguide 101 may be configured to support a $TE_{10}$ propagation mode having a frequency in the microwave portion of the electromagnetic spectrum. For example, in some embodiments the selected mode may have a characteristic frequency of approximately 2.45 GHz. Notably, however, the embodiments described herein are not limited to operation at 2.45 GHz, and in general not limited to operation in the microwave spectrum. In particular, because the operational frequency range which is selected dictates the wavelength of the selected mode(s) of operation, and the operational wavelengths are primarily limited by the geometric sizes of plasma torch 400 and waveguide 101, the operational frequency is also limited by the geometric size of plasma torch 400 and waveguide 101. Illustratively, the present teachings can be readily implemented to include operational frequencies both higher and lower that 2.45 GHz. Furthermore, the desired mode is not limited to the illustrative $TE_{10}$ mode, and the waveguide 101 (or first and/or second portions 117, 118 depicted in FIG. 1) is not necessarily rectangular in shape. Other modes, or waveguide shapes, or both, are contemplated by the present disclosure.

The present inventors have discovered that by disposing a dielectric material inside of iris hole 108, and outside of plasma torch, in particular between plasma torch 400 and an inner wall or surface in the iris structure which defines iris hole 108, the electric field may be caused to experience a phase shift or change in direction from first iris slot 110 to second iris slot 112. In particular, the present inventors have discovered that in some embodiments the electric field may be caused to experience a phase shift of 180 degrees, that is a reversal in direction from first iris slot 110 to second iris slot 112, such that the electric field at second iris slot 112 is in an opposite direction from the electric field at first iris slot 110.

Figure 6A:
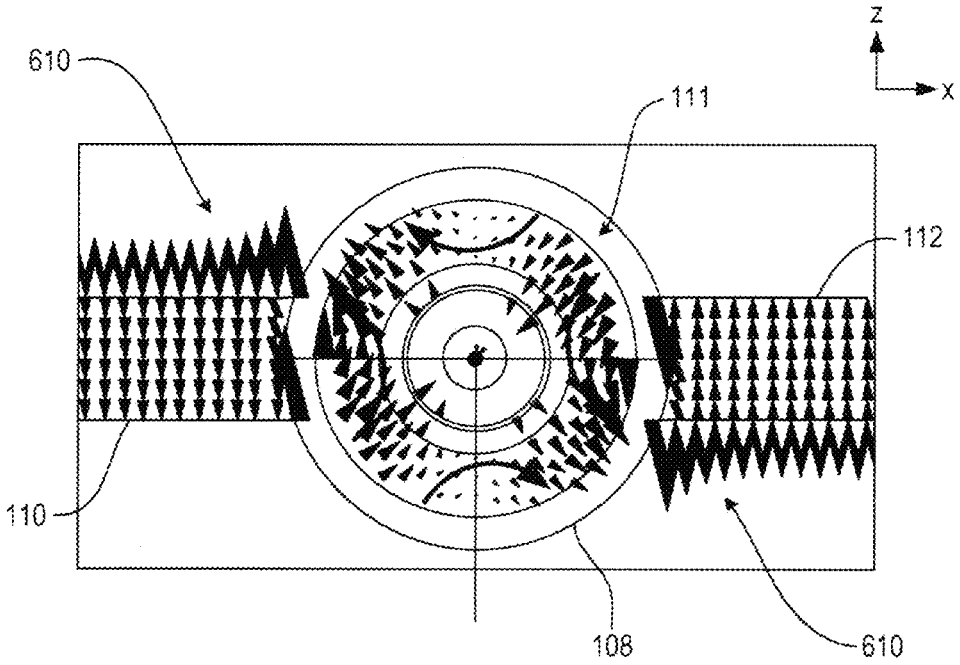
FIG. 6A is a side view depicting an example of electric field lines of a desired mode in the region of an iris of an apparatus according to the first example embodiment.

FIG. 6A is a side view depicting an example of electric field lines 610 of a desired mode in the region of iris 106 in an apparatus according to the first embodiment, where iris 106 includes iris hole 108 with cylindrical dielectric sleeve 111 disposed therein. As illustrated in FIG. 6A, the presence of cylindrical dielectric sleeve 111 causes the electric field lines 610 to be turned in direction around the interior of iris hole 108. In particular, the electric field lines 610 at first iris slot 110 at a first side of iris hole 108 are oriented in the opposite direction from the electric field lines 610 at second iris slot 112 at the second side of iris hole 108 which is opposite the first side of iris hole 108. Here it is seen that the first and second iris slots 110 and 112 are disposed at or along opposite sides of iris hole 108 in the y-direction (i.e., the direction of propagation for waveguide 101).

Figure 6B:
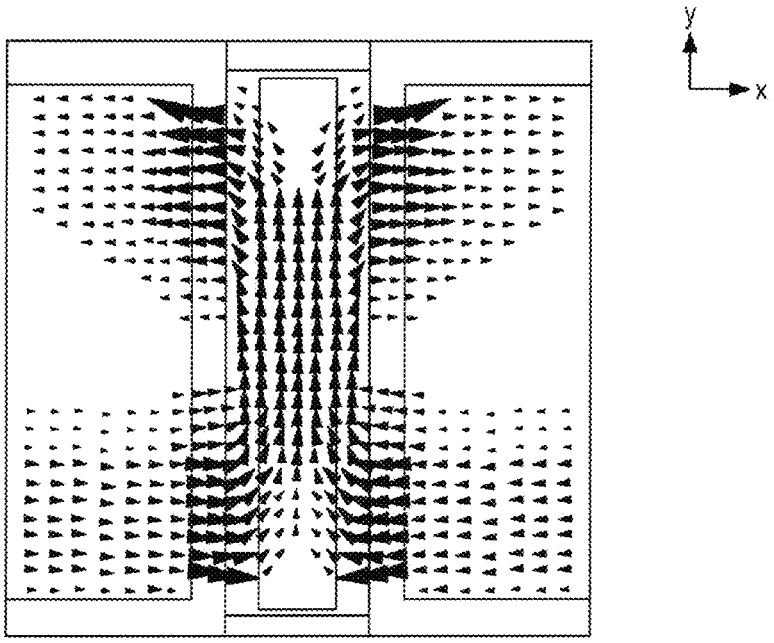
FIG. 6B is a top view depicting an example of magnetic field lines of a desired mode in the region of an iris according to the first example embodiment.

FIG. 6B is a top view depicting an example of magnetic field lines of a desired mode in the region of iris 106. It can be seen from FIG. 6B that an axial magnetic field is established wherein the magnetic field lines are parallel to central longitudinal axis 410 of plasma torch 400 throughout most of the volume enclosed by cylindrical dielectric sleeve 111.

Figure 6C:
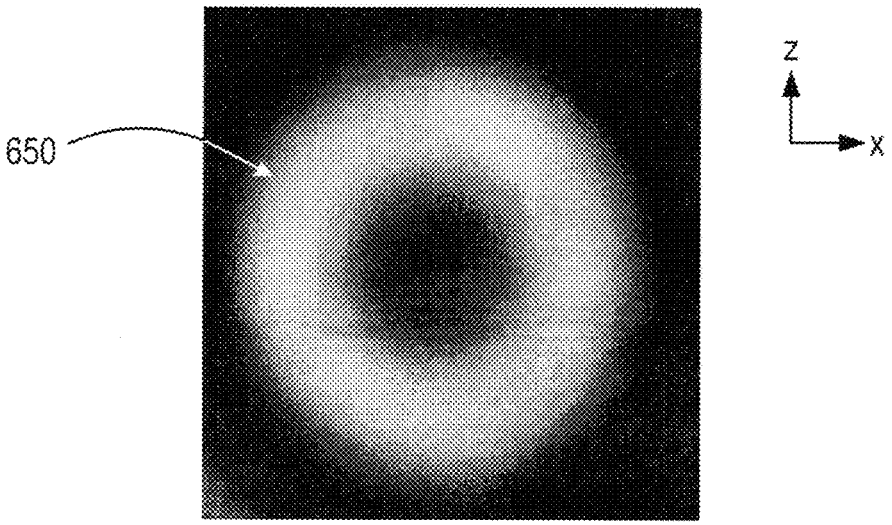
FIG. 6C is a side view of an example of a plasma generated by an example embodiment of a plasma source which employs the iris according to the first embodiment.

FIG. 6C is a side view of an example of a plasma 650 which may be generated by an example embodiment of a plasma source including the apparatus 100 and the iris 106 having iris hole 108 with cylindrical dielectric sleeve 111 disposed therein. Plasma 650 is generally confined to a cylindrical space and may be referred to as a toroidal plasma.

Although FIG. 6C illustrates an example of a plasma having a substantially toroidal shape, in other embodiments a plasma having a different shape may be generated. In some embodiments, the plasma may be symmetrical, or substantially symmetrical, about central longitudinal axis 410 with a somewhat cooler central core—for example the plasma may have the shape of a hollow rectangular prism.

In should be understood that FIGS. 1-3 and 5 illustrate a particular example embodiment with a dielectric material in the shape of a cylindrical dielectric tube or sleeve (sometimes referred to as an open cylinder or hollow cylinder) disposed within iris hole 108. However, the dielectric material may not have the shape of a cylindrical tube or sleeve. Variations of this example embodiment, and other embodiments, with a dielectric material disposed within iris hole 108 having a different shape are contemplated. In some embodiments the dielectric material may have the shape of a hollow prism, such as a hollow rectangular prism. In some embodiments, the shape of the outer surface of a cross section of the tube or sleeve may be different than the shape of the inner surface of the cross-section of the tube or sleeve—for example the outer surface may define a cylinder prism, while the inner surface defines a rectangular prism (or vice versa). These are but a few examples to illustrate the variety of shapes and configurations of the dielectric material which may be employed in various embodiments.

In some embodiments, the dielectric material (e.g., cylindrical dielectric sleeve 111) which is disposed in iris hole 108 may be disposed on an inner wall or surface of the iris structure—in particular an inner wall which defines iris hole 108. In some embodiments, the dielectric material may be disposed directly on an inner wall of the iris structure which defines iris hole 108, while in other embodiments there may be a space or gap between the dielectric material and the inner wall of the structure which defines iris hole 108. In general, the dielectric material has a dielectric constant which is greater than that or air. In some embodiments, the dielectric material may have a dielectric constant of at least 2, and more preferably a dielectric constant of at least 7. In some embodiments, the dielectric material may comprise ceramic or alumina. In other embodiments, the dielectric material may comprise one or more of the following materials: silicon nitride, aluminum nitride, sapphire, silicon. The thickness of the dielectric material may be selected depending on the dielectric constant of the material. In general, a thinner material may be employed when the dielectric constant is greater, and a thicker material may be selected when the dielectric constant is less. In some embodiments, the ratio of the thickness of cylindrical dielectric sleeve 111 to the radius of iris hole 108 may be from 10% to 30%.

In some embodiments, the total phase shift in iris hole 108 may be around $\phi_0$=90°~180° to provide a sufficient amount of variation for the electric field. For iris hole 108 having a given size, the phase shift may be increased by the presence of the dielectric material within iris hole 108. With the addition of dielectric material, we find that $\beta_g l_g+\beta_0 l_0=\phi_0$, where $\beta_g$ and $\beta_0$ are the propagation constants inside the dielectric material and in air, respectively ($\beta_g=2\pi/\lambda_g$ and $\beta_0=2\pi/\lambda_0$ where $\lambda_g$ and $\lambda_0$ are wavelengths inside the dielectric material and in air, respectively). Accordingly, we find that $2\pi\times(l_g/\lambda_g+l0/\lambda_0)=\phi_0$. This equation indicates that the shorter the wavelength in a given material, the smaller the distance which is required to produce a given phase shift. So to achieve a desired phase shift through a dielectric material such as ceramic or alumina, for example, the path length is less than that for air. Of course as a practical matter, in general iris hole 108 will not be filled entirely with a dielectric material, as space is required for the plasma torch. The equation above also indicates that if a material with a higher dielectric constant is employed (which means lower $\lambda_g$ at a given frequency) then the distance required for the phase shift can be reduced, meaning that a shorter length of dielectric material can be used and the diameter required for iris hole 108 can be reduced.

Figure 7:
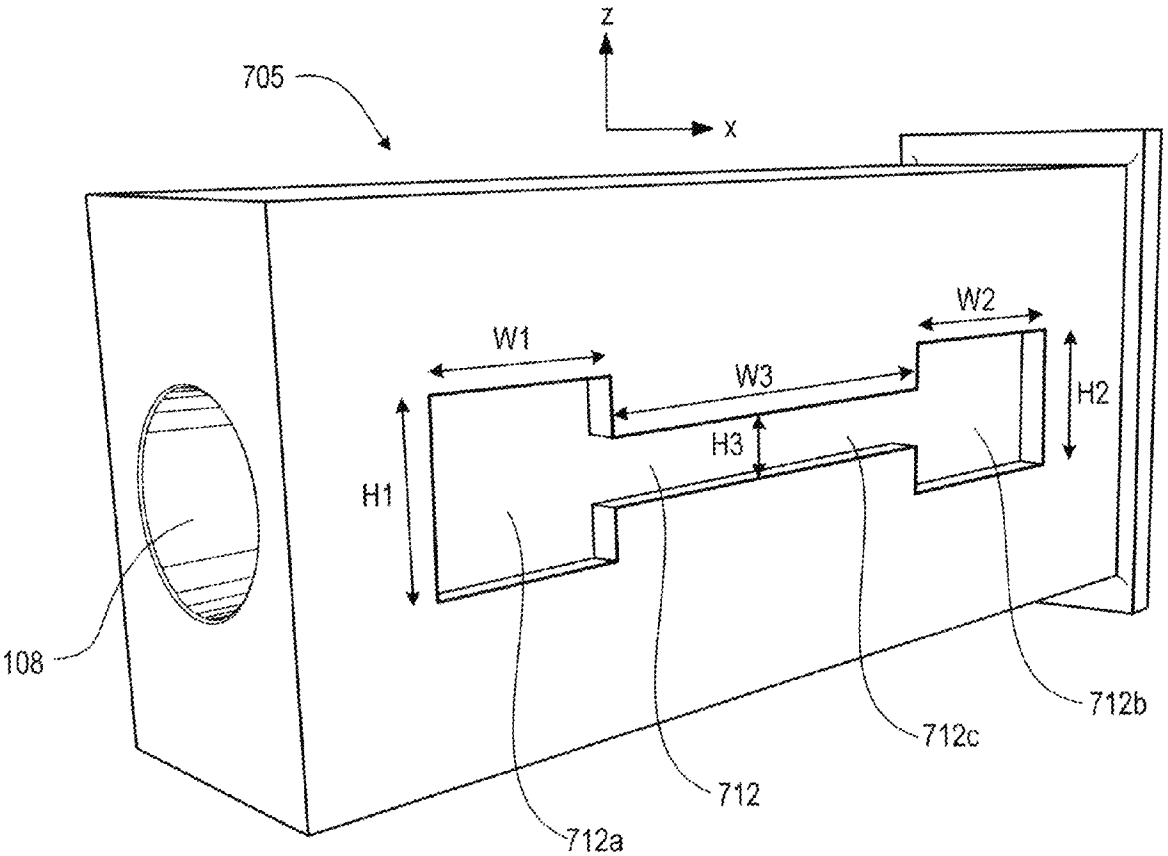
FIG. 7 is a perspective view of another example embodiment of an iris structure for defining another embodiment of an iris for a waveguide.

FIG. 7 is a perspective view of another embodiment of an iris structure 705 for defining another embodiment of an iris which may be provided in a waveguide. Iris structure 705 may be provided in waveguide 101 in the same manner that iris structure 105 may be provided in waveguide 101, as described above.

Iris structure 705 defines iris hole 108 with a first iris slot 710 disposed along a first side of iris hole 108 and a second iris slot 712 (see FIG. 9A) disposed on a second side of iris hole 108, wherein the first and second sides are separated and spaced apart from each other along the y-direction (i.e., the propagation direction in waveguide 101). In the embodiment illustrated in FIG. 7, iris hole 108 has a cylindrical shape, having a principal axis 116 of the cylinder extending in the x-direction across the width of waveguide 101 and having a substantially circular cross-section in a plane defined by the y-direction and z-direction. Also, first and second iris slots 710 and 712 are disposed at opposite sides of iris hole 108.

The present inventors have discovered that by making one or both of first and second iris slots 710 and 712 to have a greater height at the ends thereof than in the middle, the electric field can be caused to experience a phase shift or change in direction from first iris slot 710 to second iris slot 712. In particular, the present inventors have discovered that the electric field may be caused to experience a phase shift of 180 degrees, that is a reversal in direction from first iris slot 710 to second iris slot 712 such that the electric field at second iris slot 712 is in an opposite direction from the electric field at first iris slot 710.

Toward this end, in iris 706 the height (i.e., the size in the z-direction) of at least one of first and second iris slots 710 and 712 is greater at the ends of the iris slot than in the middle of the iris slot. In some embodiments, the height (i.e., the size in the z-direction) of both of first and second iris slots 710 and 712 is greater at the ends of the iris slot than in the middle of the iris slot.

Figure 8:
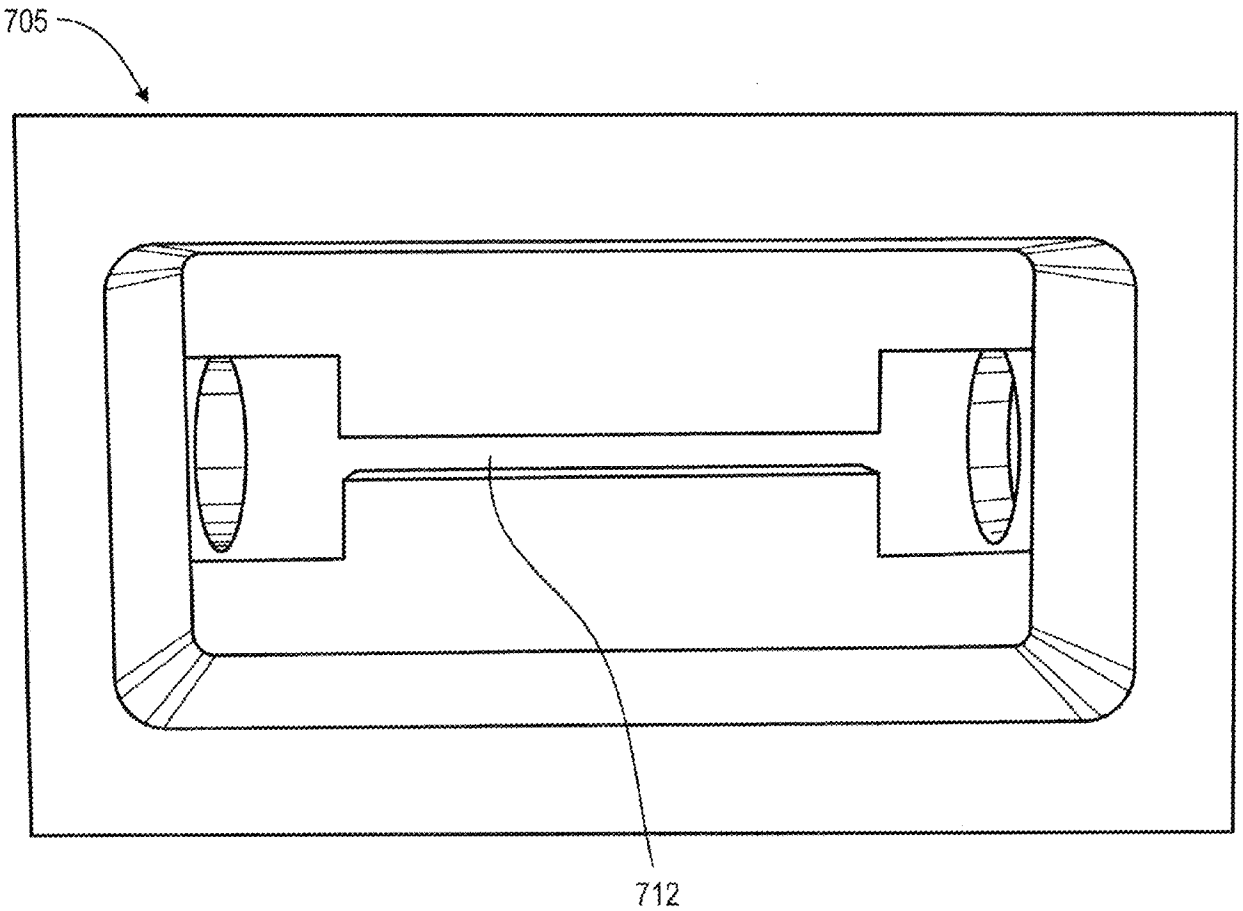
FIG. 8 is an end view of an iris according to the example embodiment illustrated in FIG. 7.

FIG. 8 is an end view of iris structure 705 according to the example embodiment illustrated in FIG. 7.

In the particular examples illustrated in FIGS. 7 and 8, second iris slot 712 has the shape which is referred to herein as a "bowtie." In particular, second iris slot 712 may be divided into three sections: a first end section 712*a* having a first width W1 and a first height H1; a second end section 712*b* having a second width W2 and a second height H2; and a central portion 712*c* disposed between first end section 712*a* and second end section 712*b*, wherein the central portion has a third width W3 and a third height H3. In some embodiments, first and second heights H1 and H2 may each be greater than third height H3. In some embodiments, first and second heights H1 and H2 may be the same as each other. In some embodiments where H1 equals H2, the first and second heights H1 and H2 may be at least twice the third height H3. In some embodiments the first and second heights H1 and H2 may be at least five times the third height H3. In some embodiments, where W1 equals W2, a ratio of W3 to W1 is in a range of between about 2.5:1 to 3.5:1.

The shape of first and second iris slot(s) 710 and/or 712 may cause the electric field to have opposite directions at opposite sides of iris 706, which generates an axial magnetic field inside iris hole 108. In some embodiments, the electric field distribution inside the plasma generated by plasma torch when disposed in it is hole 108 of iris 706 is circumferential, which is similar to that of an RF ICP source and the first embodiment described above with respect to FIGS. 1-4 and 6 A-C.

Figure 9A:
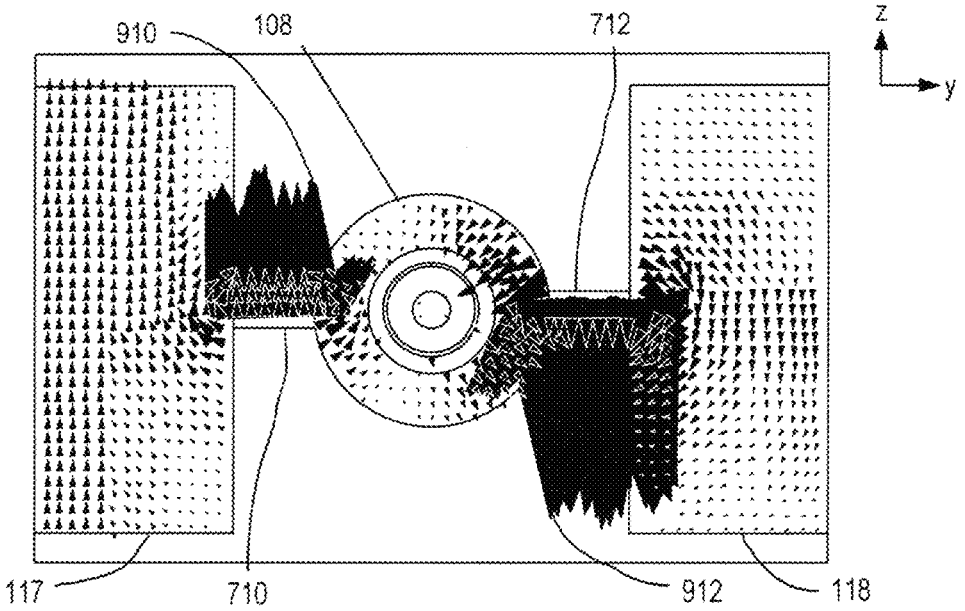
FIG. 9A is a side view depicting an example of electric field lines of a desired mode in the region of an iris according to the example embodiment illustrated in FIG. 7.

FIG. 9A is a side view depicting an example of electric field lines 910 of a desired mode in the region of iris 706, illustrating that the electric field lines 910 are turned in direction around the interior of iris hole 108. In particular, the electric field lines 910 at first iris slot 710 at a first side of iris hole 108 are oriented in the opposite direction from the electric field lines 912 at second iris slot 712 at the second side of iris hole 108 which is opposite the first side of iris hole 108. Here it is seen that the first and second iris slots 710 and 712 are disposed at opposite sides of iris hole 108 in the y-direction in the y-direction (i.e., the direction of propagation for waveguide 101).

Figure 9B:
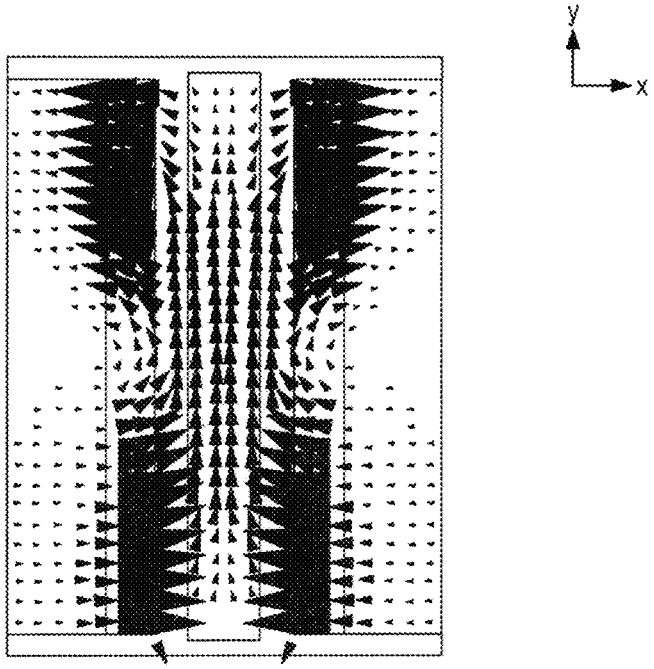
FIG. 9B is a top view depicting an example of magnetic field lines of a desired mode in the region of an iris according to the example embodiment illustrated in FIG. 7.

FIG. 9B is a top view depicting an example of magnetic field lines of a desired mode in the region of iris 706. It can be seen from FIG. 9B that an axial magnetic field is established wherein the magnetic field lines are parallel to central longitudinal axis 410 of plasma torch 400 throughout most of the volume of iris hole 108.

The electric field distribution illustrated in FIG. 9A and magnetic field distribution illustrated in FIG. 9B may produce a toroidal plasma similar to that illustrated in FIG. 6C, and so another illustration thereof is not repeated. Also, similar to iris structure 105, iris structure 705 may, in some embodiments, be employed to produce a plasma having a different shape, as discussed above.

Figure 10A:
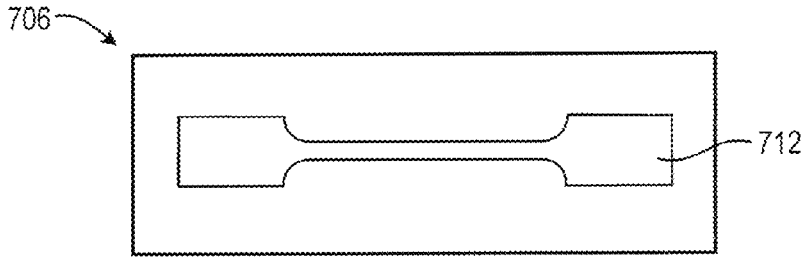
FIG. 10A is an end view illustrating one embodiment of a shape of an iris slot.
Figure 10B:
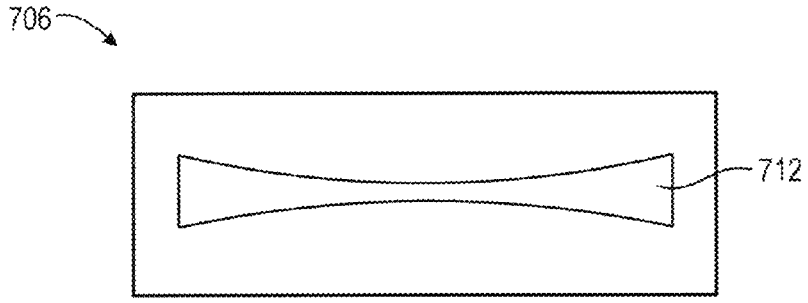
FIG. 10B is an end view illustrating another embodiment of a shape of an iris slot.
Figure 10C:
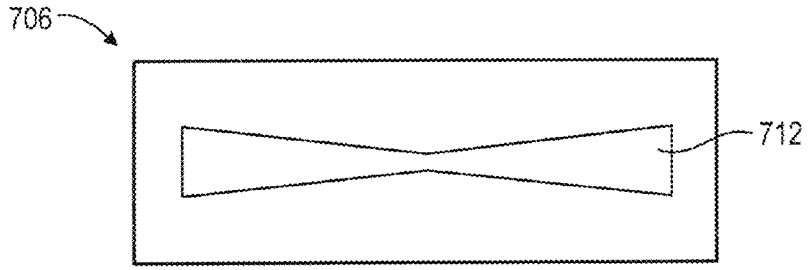
FIG. 10C is an end view illustrating another embodiment of a shape of an iris slot.
Figure 10D:
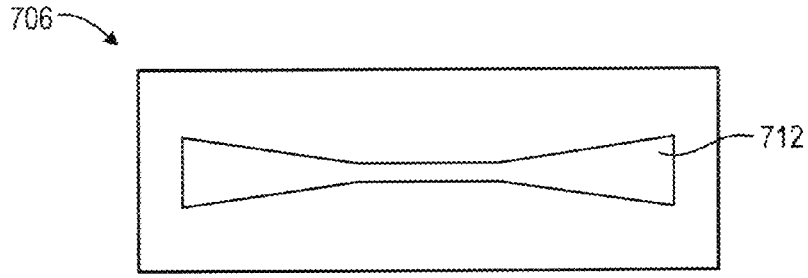
FIG. 10D is an end view illustrating another embodiment of a shape of an iris slot.

In the particular example embodiment illustrated in FIGS. 7 and 8, first and second iris slots 710 and 712 have the shape of a "bowtie," for example with rectangular first and second end sections 712*a* and 712*b*, and a rectangular central portion 712*c* disposed therebetween. However, it should be understood that in other variations of this embodiment, first and second iris slots 710 and/or 712 may have different shapes. FIGS. 10A-D illustrate a few examples of different shapes which first and second iris shot 710 and/or 712 may have. For example, FIG. 10A illustrates an embodiment where the transitions between the central portion of the iris slot and the end sections are curved. FIG. 10B illustrates an embodiment where the upper and lower edges of the iris slot are curved. FIG. 10C illustrates an embodiment where the iris slot has a height which linearly increases from the middle of the iris slot to each opposite end of the iris slot. FIG. 10D illustrates an embodiment where the first and second end sections of the iris slot are not rectangular, but instead have the shape of an isosceles trapezoid, with the short side of the trapezoid disposed adjacent the central section of the iris slot and the long end of the trapezoid being at the end of the iris slot.

Many variations of the example embodiments described above are possible. Furthermore, features of the example embodiments may be combined to produce other embodiments. In some embodiments a dielectric material may be provided inside the iris hole of an iris structure, and one or both of the iris slots of the iris structure may have a shape where the height of the iris slot is greater at the ends thereof than in the middle. In such embodiments, an axial magnetic field and an electric field having opposite directions on opposite sides of the iris may be more readily achieved for producing a desired plasma shape (e.g., toroidal). For example, by employing a bowtie-shaped iris slot in a device which includes a dielectric material in the iris hole, it may be possible to employ a thinner dielectric material and/or a dielectric material which has a lower dielectric constant. Similarly, when a dielectric material (e.g., a cylindrical dielectric sleeve) is provided in a device having a bowtie-shaped iris slot, it may be possible to reduce the difference in the height of the iris slot between the ends of the iris slot and the middle of the iris slot.

Embodiments of a waveguide-based apparatus for exciting and sustaining a plasma as described above may be employed in various systems and for various applications, including but not limited to an atomic emission spectrometer (AES) for performing atomic emission spectroscopy or a mass spectrometer for performing mass spectrometry. In some embodiments, a spectrograph (e.g., an Echelle spectrograph) may be employed to separate atomized radiation emitted by the plasma into spectral emission wavelengths that are imaged onto a camera to produce spectral data, and a processor or computer may be employed to process and display and/or store the spectral data captured by the camera

Exemplary Embodiments

In addition to the embodiments described elsewhere in this disclosure, exemplary embodiments of the present invention include, without being limited to, the following:

1. An apparatus, comprising:
an electromagnetic waveguide;
an iris structure providing an iris in the electromagnetic waveguide, the iris structure defining an iris hole, a first iris slot at a first side of the iris hole, and a second iris slot at a second side of the iris hole;
a plasma torch disposed within the iris hole; and
a dielectric material disposed in the iris hole, outside of the plasma torch.
2. The apparatus of embodiment 1, wherein the dielectric material comprises a dielectric sleeve, wherein the plasma torch is disposed inside the dielectric sleeve.
3. The apparatus of embodiment 2, wherein the dielectric sleeve is disposed on a wall defining the iris hole, with or without a gap between the dielectric sleeve and the wall.
4. The apparatus of any of the embodiments 1-3, wherein the dielectric material comprises a cylindrical dielectric sleeve.
5. The apparatus of any of the embodiments 1-4, wherein the dielectric material has a thickness which is between 10-30% of a radius of the iris hole.
6. The apparatus of any of the embodiments 1-5, wherein the dielectric material is alumina.
7. The apparatus of any of the embodiments 1-6, wherein the dielectric material has a dielectric constant of at least 2.
8. The apparatus of any of the embodiments 1-7, wherein the dielectric material has a dielectric constant of at least 7.
9. An apparatus, comprising:
an electromagnetic waveguide;
an iris structure providing an iris in the electromagnetic waveguide, the iris structure defining an iris hole, a first iris slot at a first side of the iris hole, and a second iris slot at a second side of the iris hole; and
a plasma torch disposed within the iris hole,
wherein a height of at least one of the iris slots is greater at ends thereof than in a middle thereof.
10. The apparatus of embodiment 9, wherein the height of each of the iris slots is greater at the ends thereof than in the middle thereof
11. The apparatus of any of the embodiments 9 and 10, wherein at least one of the iris slots includes:
a first end section having a first height;
a second end section having a second height; and
a central portion disposed between the first end section and the second end section, wherein the central portion has a third height,
wherein the third height is less than the first height and the second height.
12. The apparatus of embodiment 11, wherein the first height is the same as the second height.
13. The apparatus of any of the embodiments 11-12, wherein the first height and second height are each at least twice the third height.
14. The apparatus of any of the embodiments 11-13, wherein the first height and second height are each at least five times the third height.
15. The apparatus of any of the embodiments 11-14, wherein the first end section has a first width, the second end section has a second height, and the central portion has a third width, wherein the first width is the same as the second width.

16. The apparatus of embodiment 15, wherein the first width and second width are each about one third the third width.

17. The apparatus of any of the embodiments 9-16, further comprising a dielectric material disposed in the iris hole outside of the plasma torch.

18. The apparatus of any of the embodiments 1-17, wherein the plasma torch generates a plasma in the iris hole, and wherein the plasma is substantially symmetrical around a longitudinal axis of the plasma torch.

19. The apparatus of embodiment 18, wherein the plasma has a substantially toroidal shape.

20. The apparatus of any of the embodiments 1-19, wherein an axial magnetic field is established extending along a longitudinal axis of the plasma torch.

21. An apparatus, comprising:

an electromagnetic waveguide;

an iris structure providing an iris in the electromagnetic waveguide, the iris structure defining an iris hole, a first iris slot at a first side of the iris hole, and a second iris slot at a second side of the iris hole; and a plasma torch disposed within the iris hole, wherein an electric field in the waveguide changes direction from the first iris slot to the second iris slot.

22. The apparatus of embodiment 21, wherein the electric field at the second iris slot is in an opposite direction from the electric field at the first iris slot.

23. The apparatus of any of the embodiments 21-22, further comprising a dielectric material disposed in the iris hole outside of the plasma torch.

24. The apparatus of any of the embodiments 21-22, wherein the height of at least one of the iris slots is greater at ends thereof than in a middle thereof 25. The apparatus of any of the embodiments 21-24, wherein the plasma torch generates a plasma in the iris hole, and wherein the plasma is substantially symmetrical around a longitudinal axis of the plasma torch.

26. The apparatus of embodiment 25, wherein the plasma has a substantially toroidal shape.

27. The apparatus of any of the embodiments 21-26, wherein an axial magnetic field is established extending along a longitudinal axis of the plasma torch.

28. An atomic emission spectrometer comprising the apparatus of any of the embodiments 1-27.

29. A method, comprising:

disposing a plasma torch within an iris hole defined by an iris structure which provides an iris in an electromagnetic waveguide; and generating an electromagnetic field, wherein an electric field in the waveguide changes direction from the first side of the iris to second side of the iris, wherein the first and second sides of the iris are on opposite sides of the iris from each other with respect to a propagation direction of the electromagnetic field.

30. The method of embodiment 29, wherein the electric field at the second side of the iris is in an opposite direction from the electric field at first side of the iris.

31. The method of any of the embodiments 29-30, further comprising establishing an axial magnetic field extending along a longitudinal axis of the plasma torch.

32. The method of any of the embodiments 29-31, further comprising:

providing a plasma-forming gas to the plasma torch;

applying electromagnetic power to establish the electromagnetic field; and generating a plasma.

33. The method of embodiment 32, wherein the plasma has a substantially toroidal shape.

34. The method of any of the embodiments 32-33, further comprising introducing a sample to the plasma.

A number of embodiments of the invention have been described. Nevertheless, one of ordinary skill in the art appreciates that many variations and modifications are possible without departing from the spirit and scope of the present invention and which remain within the scope of the appended claims. The invention therefore is not to be restricted in any way other than by the scope of the claims.

What is claimed is:

1. An apparatus, comprising:

an electromagnetic waveguide;

an iris structure providing an iris in the electromagnetic waveguide, the iris structure defining an iris hole, a first iris slot at a first side of the iris hole, and a second iris slot at a second side of the iris hole;

a plasma torch disposed within the iris hole and comprising an outermost surface, wherein a gap is defined in the iris hole between the outermost surface and the iris structure; and a dielectric material disposed in the gap, outside of the plasma torch.

2. The apparatus of claim 1, wherein the dielectric material comprises a dielectric sleeve, wherein the plasma torch is disposed inside the dielectric sleeve.

3. The apparatus of claim 1, wherein the dielectric material comprises a cylindrical dielectric sleeve.

4. The apparatus of claim 1, wherein the dielectric material is alumina.

5. The apparatus of claim 1, wherein the dielectric material has a dielectric constant of at least 2.

6. The apparatus of claim 1, wherein the dielectric material has a dielectric constant of at least 7.

7. An apparatus, comprising:

an electromagnetic waveguide;

an iris structure providing an iris in the electromagnetic waveguide, the iris structure defining an iris hole, a first iris slot at a first side of the iris hole, and a second iris slot at a second side of the iris hole; and a plasma torch disposed within the iris hole, wherein a height of at least one of the iris slots is greater at ends thereof than in a middle thereof.

8. The apparatus of claim 7, wherein the height of each of the iris slots is greater at the ends thereof than in the middle thereof.

9. The apparatus of claim 7, wherein at least one of the iris slots includes:

a first end section having a first height;

a second end section having a second height; and a central portion disposed between the first end section and the second end section, wherein the central portion has a third height, wherein the third height is less than the first height and the second height.

10. The apparatus of claim 9, wherein the first end section has a first width, the second end section has a second height, and the central portion has a third width, wherein the first width is the same as the second width.

11. The apparatus of claim 9, further comprising a dielectric material disposed in the iris hole outside of the plasma torch.

12. The apparatus of claim 9, wherein the apparatus is configured to generate a plasma in the iris hole, and wherein the plasma is substantially symmetrical around a longitudinal axis of the plasma torch.

13. The apparatus of claim 12, wherein the plasma has a substantially toroidal shape.

14. The apparatus of any claim 9, wherein, in operation, an axial magnetic field is established extending along a longitudinal axis of the plasma torch.

15. An apparatus, comprising:

an electromagnetic waveguide;

an iris structure providing an iris in the electromagnetic waveguide, the iris structure defining an iris hole, a first iris slot at a first side of the iris hole, and a second iris slot at a second side of the iris hole; and a plasma torch disposed within the iris hole, wherein, in operation, an electric field in the waveguide changes direction from the first iris slot to the second iris slot.

16. The apparatus of claim 15, wherein the electric field at the second iris slot is in an opposite direction from the electric field at the first iris slot.

17. The apparatus of claim 15, further comprising a dielectric material disposed in the iris hole outside of the plasma torch.

18. The apparatus of claim 15, wherein the height of at least one of the iris slots is greater at ends thereof than in a middle thereof.

19. The apparatus of claim 15, wherein the apparatus is configured to generate a plasma in the iris hole, and wherein the plasma is substantially symmetrical around a longitudinal axis of the plasma torch.

20. The apparatus of claim 19, wherein the plasma has a substantially toroidal shape.

* * * * *

UNITED STATES PATENT AND TRADEMARK OFFICE

CERTIFICATE OF CORRECTION

PATENT NO. : 9,247,629 B2
APPLICATION NO. : 13/838474
DATED : January 26, 2016
INVENTOR(S) : Mehrnoosh Vahidpour et al.

It is certified that error appears in the above-identified patent and that said Letters Patent is hereby corrected as shown below:

In the Specification

In column 10, line 2, after "camera" insert -- . --.

In column 10, line 48, after "thereof" insert -- . --.

In column 11, line 34, after "thereof" insert -- . --.

In the Claims

In column 13, line 1, in claim 14, delete "any claim" and insert -- claim --, therefor.

Signed and Sealed this
Twenty-sixth Day of July, 2016

Michelle K. Lee

Michelle K. Lee
*Director of the United States Patent and Trademark Office*